US012286743B2

(12) United States Patent
Lim et al.

(10) Patent No.: US 12,286,743 B2
(45) **Date of Patent: *Apr. 29, 2025**

(54) LAUNDRY TREATMENT APPARATUS

(71) Applicant: LG ELECTRONICS INC., Seoul (KR)

(72) Inventors: Hyunggyu Lim, Seoul (KR); Taejun Yoon, Seoul (KR); Minhyoung Lee, Seoul (KR); Jeongryeol Choi, Seoul (KR); Junyoung Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/227,870

(22) Filed: Jul. 28, 2023

(65) Prior Publication Data

US 2023/0374721 A1 Nov. 23, 2023

Related U.S. Application Data

(60) Continuation of application No. 17/519,896, filed on Nov. 5, 2021, now Pat. No. 11,713,540, which is a (Continued)

(30) Foreign Application Priority Data

Nov. 11, 2016 (KR) ..... 10-2016-0150161

(51) Int. Cl.
*D06F 71/29* (2006.01)
*D06F 67/00* (2006.01)

(Continued)

(52) U.S. Cl.
CPC ..... *D06F 71/29* (2013.01); *D06F 67/00* (2013.01); *D06F 67/005* (2013.01); *D06F 73/02* (2013.01);

(Continued)

(58) Field of Classification Search
CPC .. D06F 71/00–40; D06F 67/00; D06F 67/005; D06F 73/02; D06F 73/00; D06F 58/10; D06F 58/203; D06F 58/14
See application file for complete search history.

(56) References Cited

U.S. PATENT DOCUMENTS 2,255,173 A * 9/1941 Laursen ..... D06F 81/06 108/38
2,963,804 A 12/1960 Frechette (Continued)

FOREIGN PATENT DOCUMENTS

CN 1170061 A 1/1998
CN 1805868 A 7/2006

(Continued)

*Primary Examiner* — Ismael Izaguirre
(74) *Attorney, Agent, or Firm* — Bryan Cave Leighton Paisner LLP

(57) ABSTRACT

A laundry treatment apparatus is disclosed. The laundry treatment apparatus includes a cabinet having an accommodation space formed therein to accommodate laundry, a door hingedly connected to the cabinet to open or close the accommodation space, a presser for applying pressure to laundry to remove wrinkles from laundry, and a presser-fixing structure for mounting the presser to the inner surface of the accommodation space or the door. The presser-fixing structure includes a support holder protruding from the inner surface of the accommodation space or the door and a presser-fixing recess formed concavely in the rear surface of the presser so as to allow the support holder to be inserted thereinto.

10 Claims, 7 Drawing Sheets

Related U.S. Application Data continuation of application No. 16/394,790, filed on Apr. 25, 2019, now Pat. No. 11,193,235, which is a division of application No. 15/809,191, filed on Nov. 10, 2017, now Pat. No. 10,316,462.

(51) Int. Cl.

| | |
|---|---|
| ***D06F 73/02*** | (2006.01) |
| *D06F 58/10* | (2006.01) |
| *D06F 58/20* | (2006.01) |
| *D06F 71/36* | (2006.01) |

(52) U.S. Cl.

CPC ..... *D06F 58/10* (2013.01); *D06F 58/203* (2013.01); *D06F 71/36* (2013.01)

(56) References Cited

U.S. PATENT DOCUMENTS

| | | | | |
|---|---|---|---|---|
| 3,070,268 | A | 12/1962 | Carpenter | D06F 71/16 223/57 |
| 3,203,122 | A | 8/1965 | Sweatt | D06F 71/34 38/104 |
| 3,259,082 | A | 7/1966 | Williams | |
| 3,313,054 | A | 4/1967 | Madey | G09F 7/20 40/651 |
| 3,891,172 | A * | 6/1975 | Einhorn | A47G 25/0607 248/222.13 |
| 4,510,872 | A | 4/1985 | Parry | B43M 99/00 108/25 |
| 4,684,787 | A | 8/1987 | Bunting | D06F 58/10 219/400 |
| 4,823,488 | A | 4/1989 | Fottner | |
| 4,973,021 | A * | 11/1990 | Schuite | A47G 1/1686 248/327 |
| 5,305,484 | A * | 4/1994 | Fitzpatrick | D06F 73/02 68/6 |
| 5,329,860 | A | 7/1994 | Mattesky | |
| 5,555,640 | A | 9/1996 | Ou | A47L 19/00 211/133.6 |
| 5,570,642 | A | 11/1996 | Lehrman | |
| 5,810,304 | A * | 9/1998 | Lehrman | D06F 81/00 248/308 |
| 5,815,961 | A | 10/1998 | Estes | D06F 73/02 38/14 |
| 5,961,090 | A * | 10/1999 | Parkin | A47G 1/1606 248/475.1 |
| 6,581,788 | B1 * | 6/2003 | Winig | F16B 12/26 211/183 |
| D491,449 | S | 6/2004 | Winig | B43M 99/00 D8/381 |
| 7,062,871 | B1 | 6/2006 | Smidt | A47B 77/10 108/35 |
| 7,707,252 | B1 | 4/2010 | Harris | G06Q 10/107 709/206 |
| 7,708,252 | B2 * | 5/2010 | Vander Berg | A47G 1/1606 248/475.1 |
| 8,308,116 | B2 * | 11/2012 | Daniels | A47G 25/0678 211/106.01 |
| 8,413,938 | B2 * | 4/2013 | Whelan | F16M 13/02 248/201 |
| D732,772 | S * | 6/2015 | Chung | D32/25 |
| 9,359,717 | B2 | 6/2016 | Lim | D06F 71/36 |
| 10,316,462 | B2 * | 6/2019 | Lim | D06F 67/005 |
| 11,193,235 | B2 * | 12/2021 | Lim | D06F 67/005 |
| 11,713,540 | B2 * | 8/2023 | Lim | D06F 67/005 38/69 |
| 2010/0282785 | A1 | 11/2010 | Roselle | D06F 58/203 223/61 |
| 2015/0020419 | A1 | 1/2015 | Park | D06F 67/005 38/3 |
| 2015/0159315 | A1 | 6/2015 | Lim et al. | |
| 2015/0259845 | A1 | 9/2015 | Doyle et al. | |
| 2015/0308613 | A1 | 10/2015 | Callif | A47G 1/20 248/216.1 |

FOREIGN PATENT DOCUMENTS

| | | | |
|---|---|---|---|
| CN | 101701417 | A | 5/2010 |
| CN | 104294529 | A | 1/2015 |
| CN | 104695195 | A | 6/2015 |
| CN | 105714543 | A | 6/2016 |
| DE | 9301574 | U1 | 5/1993 |
| EP | 2322707 | A1 | 5/2011 |
| EP | 2826911 | A1 | 1/2015 |
| EP | 2889426 | A1 | 7/2015 |
| EP | 3034684 | A1 | 6/2016 |
| JP | S4734352 | Y1 | 10/1972 |
| JP | 2019534100 | A | 11/2019 |
| KR | 20-2010-0004508 | U | 5/2010 |
| KR | 20120091799 | A | 8/2012 |
| KR | 1020150009718 | A | 1/2015 |
| KR | 1020150065297 | A | 6/2015 |
| WO | 87/00218 | A1 | 1/1987 |
| WO | 94002057 | A1 | 2/1994 |
| WO | WO9402057 | A1 | 2/1994 |
| WO | 2009150262 | A1 | 12/2009 |
| WO | 2015105524 | A1 | 7/2015 |
| WO | 2016099225 | A1 | 6/2016 |

* cited by examiner

LAUNDRY TREATMENT APPARATUS

This application is a Continuation Application of U.S. application Ser. No. 17/519,896 filed on Nov. 5, 2021, which is a Continuation Application of U.S. application Ser. No. 16/394,790 filed on Apr. 25, 2019, issued as U.S. Pat. No. 11,923,235, which is a Divisional Application of U.S. application Ser. No. 15/809,191 filed on Nov. 10, 2017, issued as U.S. Pat. No. 10,316,462, which claims the benefit of and priority to Korean Patent Application No. 10-2016-0150161 filed on Nov. 11, 2016, each of which is hereby incorporated by reference in their entirety as if fully set forth herein.

BACKGROUND OF THE INVENTION

Field of the Invention

The present invention relates to a laundry treatment apparatus.

Discussion of the Related Art

Generally, laundry treatment apparatuses refer to apparatuses that perform a variety of operations related to laundry (washing, drying, deodorization, wrinkle removal, and the like). Examples of laundry treatment apparatuses include washing machines that wash, rinse and dry laundry, drying machines that dry wet laundry, and refreshers for deodorization of, and removal of wrinkles from, laundry.

Conventional laundry treatment apparatuses include a drum, in which laundry is received, and perform washing, drying and refreshing through rotation of the drum. However, such conventional laundry treatment apparatuses are problematic in that a user cannot wear the laundry immediately after taking the same out of the drum due to wrinkles, in that frequent washing using wash water causes damage to the laundry, and in that energy consumption is high due to the operation of a motor for rotating the drum.

In order to solve the above problems, laundry treatment apparatuses, from which a tub for storing wash water or a rotary drum is removed and which performs washing, drying and refreshing by supplying steam or hot air to laundry hung on a hanger, have been developed.

Laundry treatment apparatuses may include a presser for putting a crease in laundry or removing wrinkles from laundry.

However, conventional laundry treatment apparatuses are configured such that a presser is fixedly mounted to a door, making it impossible to move the position of the presser and frequently requiring a user to use an additional presser.

SUMMARY OF THE INVENTION

Accordingly, the present invention is directed to a laundry treatment apparatus that substantially obviates one or more problems due to limitations and disadvantages of the related art.

An object of the present invention is to provide a laundry treatment apparatus, which is capable of performing washing, drying, deodorization, sterilization and wrinkle removal of laundry.

Another object of the present invention is to provide a laundry treatment apparatus, which removes wrinkles from laundry and applies pressure to laundry so as to sharpen a crease formed in the laundry.

A further object of the present invention is to provide a laundry treatment apparatus, which includes a presser that is removably mounted thereto so that the position of the presser may be moved.

A further object of the present invention is to provide a laundry treatment apparatus, which includes a presser that is greatly reduced in thickness so that the position of the presser may be efficiently moved in the inner space in the laundry treatment apparatus.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a laundry treatment apparatus includes a cabinet having an accommodation space formed therein to accommodate laundry, a door hingedly connected to the cabinet to open or close the accommodation space, a presser for applying pressure to laundry to remove wrinkles from laundry, and a presser-fixing structure for mounting the presser to the inner surface of the accommodation space or the door, wherein the presser-fixing structure includes a support holder protruding from the inner surface of the accommodation space or the door and a presser-fixing recess formed concavely in the rear surface of the presser so as to allow the support holder to be inserted thereinto.

The presser-fixing structure may further include a support-part-fixing hole formed in the inner surface of the accommodation space or the door and a support-part-fixing protrusion extending from the support holder so as to be fitted into the support-part-fixing hole.

The support holder may have a support recess formed concavely therein, and the presser-fixing recess may be provided with a presser-fixing protrusion, the presser-fixing protrusion protruding from the inner surface of the presser-fixing recess so as to be inserted into the support recess.

The presser-fixing protrusion may be configured to be movable upwards and downwards by an elastic member having elastic force.

The support recess may be formed in the top surface of the support holder.

The support holder may include a first support holder and a second support holder spaced a predetermined distance apart from the first support holder, and the presser-fixing recess may include a first presser-fixing recess formed to allow the first support holder to be inserted thereinto and a second presser-fixing recess formed to allow the second support holder to be inserted thereinto.

The first support holder may have a first support recess formed concavely therein, the second support holder may have a second support recess formed concavely therein, the first presser-fixing recess may be provided with a first presser-fixing protrusion, the first presser-fixing protrusion protruding from the inner surface of the first presser-fixing recess so as to be inserted into the first support recess, and the second presser-fixing recess may be provided with a second presser-fixing protrusion, the second presser-fixing protrusion protruding from the inner surface of the second presser-fixing recess so as to be inserted into the second support recess.

The first support recess may be formed in the top surface of the first support holder, and the second support recess may be formed in the top surface or the bottom surface of the second support holder.

The first presser-fixing protrusion or the second presser-fixing protrusion may be configured to be movable upwards and downwards by an elastic member having elastic force.

The first presser-fixing protrusion and the second presser-fixing protrusion may be configured to be movable upwards and downwards by an elastic member having elastic force.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
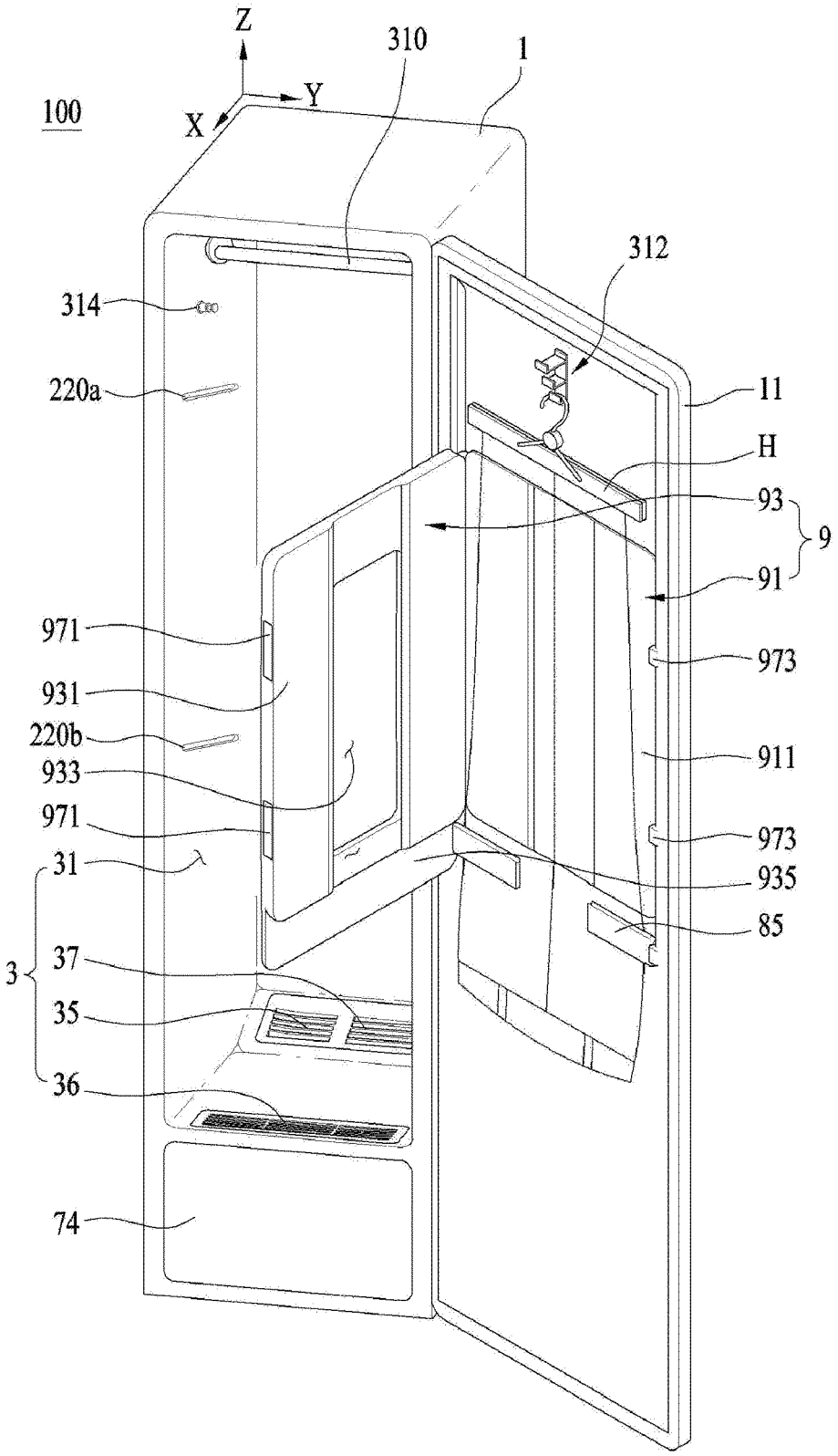
FIG. 1 is a view illustrating a laundry treatment apparatus according to one embodiment of the present invention.

Hereinafter, exemplary embodiments of the present invention will be described in detail with reference to the accompanying drawings. Meanwhile, the configuration of an apparatus or a control method of the apparatus, which will be described below, is merely given to describe the embodiments of the present invention, and is not intended to limit the scope of the present invention. The same reference numerals used throughout the specification refer to the same constituent elements.

Figure 2:
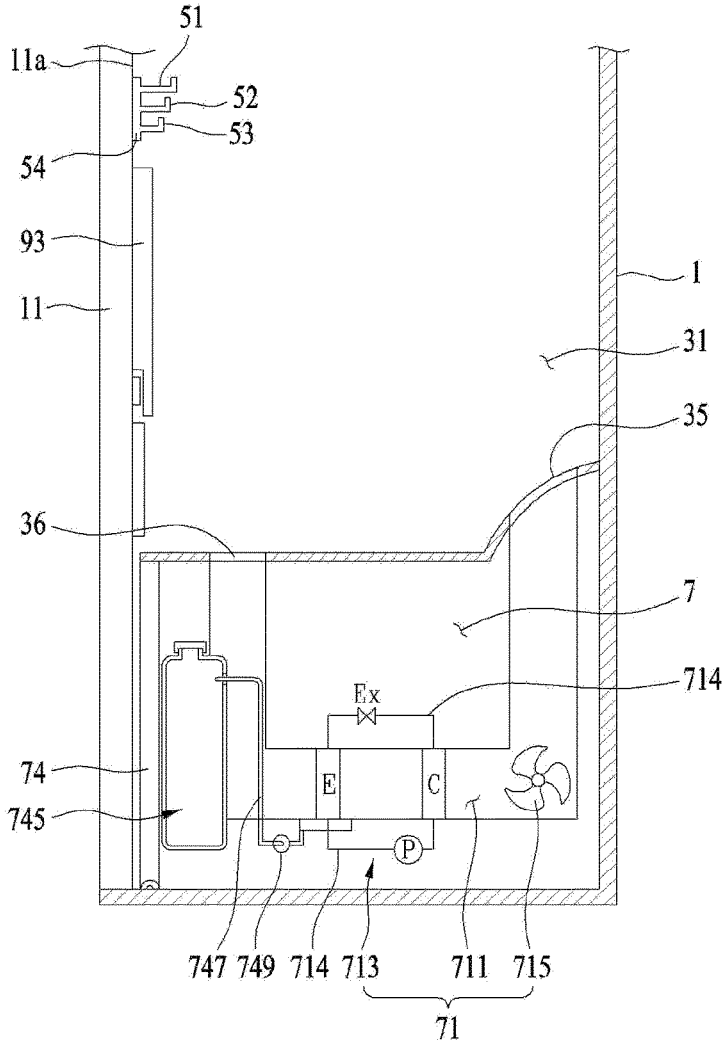
FIGS. 2 and 3 are sectional views of the laundry treatment apparatus according to the embodiment of the present invention.
Figure 3:
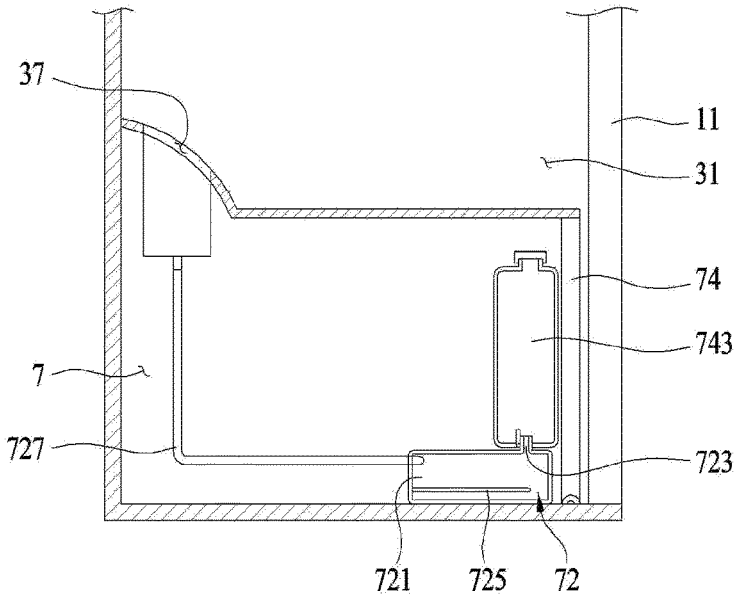

FIG. 1 is a view illustrating a laundry treatment apparatus according to one embodiment of the present invention. FIGS. 2 and 3 are sectional views of the laundry treatment apparatus according to the embodiment of the present invention.

Hereinafter, the laundry treatment apparatus of the present invention will be described with reference to FIG. 1.

The laundry treatment apparatus 100 of the present invention may include a cabinet 1 and a laundry accommodation unit 3, which is provided in the cabinet to accommodate laundry therein.

The cabinet 1 may form the external appearance of the laundry treatment apparatus 100, and may be formed in the shape of a rectangular parallelepiped.

The laundry accommodation unit 3 may include an accommodation space 31, which is provided in the cabinet 1 to accommodate laundry therein.

The laundry treatment apparatus 100 may include a door 11, which is hingedly connected to the cabinet 1 in order to open or close the accommodation space 31.

The laundry treatment apparatus 100 may include a laundry support member for supporting laundry in the accommodation space 31.

The laundry support member may include at least one of a first laundry support member 310, which is provided in the accommodation space 31, a second laundry support member 312, which is provided at the door 11, and a third laundry support member 314, which is provided at an inner surface 31*a* of the accommodation space 31.

The first laundry support member 310 may take the form of a bar that extends in the width direction of the accommodation space 31 (i.e. in the width direction of the door 11 or in the Y-axis direction).

Laundry may be supported by the first laundry support member 310 via a hook provided at a hanger H.

The second laundry support member 312 may be provided at the door 11 to allow laundry to be placed in the accommodation space 31 while being kept spread.

The third laundry support member 314 may be affixed to at least one of the rear surface, the left surface and the right surface, which constitute the inner surface 31*a* of the accommodation space 31.

Referring to FIG. 2, the second laundry support member 312 may include a base 54 affixed to the door 11 and one or more support pieces 51, 52 and 53 protruding from the base 54 and arranged in the height direction of the door 11 (i.e. in the Z-axis direction).

The laundry treatment apparatus 100 may include a machine room 7, which is provided in the cabinet 1 so as to be isolated from the accommodation space 31, and a supply unit, which is provided in the machine room 7 to supply at least one of air and moisture to the laundry accommodation unit.

The machine room 7 may be positioned below the accommodation space 31.

Air supplied to the accommodation space 31 by the supply unit may be heated air (or hot air), and moisture supplied to the accommodation space 31 by the supply unit may be steam.

The supply unit may include at least one of an air supply unit 71 for supplying air (heated air or unheated air) to the accommodation space 31 and a moisture supply unit for supplying moisture (steam or mist) to the accommodation space 31.

Hereinafter, for convenience of description, it is assumed that the supply unit includes both the air supply unit 71 and the moisture supply unit 72, the air supply unit 71 supplies hot air to the accommodation space 31, and the moisture supply unit 72 supplies steam to the accommodation space 31.

The air supply unit 71 may include a circulation duct 711 for circulation of internal air in the accommodation space 31, a heat exchanger 713 for heat exchange with air moving through the circulation duct 711, and a blower 715 for movement of internal air in the accommodation space 31 through the circulation duct 711.

The circulation duct 711 communicates with the interior of the accommodation space 31 through an air discharge port 35 and an air suction port 36, which are provided at the accommodation space 31, and internal air in the accommodation space sequentially circulates through the air suction port, the circulation duct, the air discharge port and the accommodation space.

The air discharge port 35 and the air suction port 36 are formed so as to penetrate the bottom of the accommodation space 31. The circulation duct 711 mounted in the machine room 7 is connected at one end thereof to the air suction port 36 and at the other end thereof to the air discharge port 35.

The heat exchanger 713 serves to dehumidify and heat air introduced into the circulation duct 711. The heat exchanger 713 may take the form of a heat pump; however, the heat exchanger in the laundry treatment apparatus of the present invention is not limited to a heat pump.

The heat exchanger 713 may include an evaporator E disposed in the circulation duct 711, a condenser C disposed in the circulation duct 711, a compressor P disposed outside the circulation duct 711, and an expansion device Ex disposed outside the circulation duct 711. The evaporator E, the compressor P, the condenser C, and the expansion device Ex are connected to one another via refrigerant tubes 714.

The compressor P serves to compress refrigerant to a high pressure to allow the refrigerant to be circulated through the refrigerant tubes 714. The evaporator E serves to evaporate the refrigerant by absorbing heat from air within the circulation duct 711. The condenser C serves to condense the refrigerant by discharging heat to the air within the circulation duct 711.

The blower 715 is located in the circulation duct 711 and serves to cause circulation of the internal air in the accommodation space 31 through the circulation duct 711. The blower 715 may be located between the condenser C and the air discharge port 35.

When the blower 715 is operated, the air within the circulation duct 711 moves to the accommodation space 31 through the air discharge port 35, and the air within the accommodation space 31 moves to the circulation duct 711 through the air suction port 36.

The air introduced into the circulation duct 711 through the air suction port 36 is cooled while passing through the evaporator E, and in turn, the air having passed through the evaporator E is heated while passing through the condenser C.

When the air is cooled while passing through the evaporator E, moisture contained in the air is removed (dehumidification), and the moisture removed from the air (condensed water) remains on the surface of the evaporator E or within the circulation duct 711.

The laundry treatment apparatus 100 according to the embodiment may include a drain unit for removing condensed water generated by the evaporator E. The drain unit serves to prevent the heat exchange efficiency of the heat exchanger 713 from being deteriorated due to the condensed water remaining in the circulation duct 711.

The drain unit may include a drain tank 745, which is removably mounted to the machine room door 74, and a drain pipe 747 and a drain pump 749, which serve to supply the condensed water from the circulation duct 711 to the drain tank 745.

Meanwhile, as is exemplarily shown in FIG. 3, the moisture supply unit 72 may include a reservoir 721 disposed in the machine room 7, a heater 725 disposed in the reservoir 721, and a moisture supply pipe 727 connecting the reservoir 721 to a moisture discharge port 37.

The reservoir 721 serves to store water therein. The heater 725 serves to heat the water stored in the reservoir 721 to convert the water into steam. The moisture supply pipe 727 serves to guide steam from the reservoir 721 to the accommodation space 31.

The reservoir 721 receives water via a water supply unit. The water supply unit may include a water supply tank 743, which is removably mounted to the machine room door 74.

The reservoir 721 may be provided with a connection pipe 723, which is connected to the water supply tank 743 when the machine room door 74 closes the machine room 7 and which is separated from the water supply tank 743 when the machine room door 74 opens the machine room 7.

The reason why the water supply tank 743 is removably mounted to the machine room door 74 is that the laundry treatment apparatus 100 according to the present invention may be installed at a position distant from a water supply source (not shown).

The laundry treatment apparatus 100 according to the present invention is configured to supply hot air or steam while keeping laundry spread within the accommodation space 31, thereby preventing the laundry from being wrinkled after steam or hot air is completely supplied thereto.

The laundry treatment apparatus 100 according to the embodiment may include a presser 9, which is provided in the laundry accommodation unit to remove wrinkles from laundry or form a crease in laundry.

The presser 9 may be configured to press laundry in order to remove wrinkles from laundry or form a crease in laundry.

The presser 9 may include a support part 91, which is provided at the inner surface 31*a* of the accommodating space 31 or the door 11 to support laundry, and a press part 93, which is hingedly connected to the support part 91 to apply pressure to laundry placed in the support part 91.

The support part 91 may include a support body 911, which may be provided at the surface of the door 11 that faces the accommodation space 31 or may be provided at the inner surface 31*a* of the accommodation space 31.

The press part 93 may include a press body 931, which has one side hingedly connected to one side of the support body 911 and the opposite side functioning as a free end and detachably attached to the opposite side of the support body 911, and a body through-hole 933, which is formed through the press body 931.

The press body 931 may be separably coupled to the support body 911 via coupling members 971 and 973.

The coupling members 971 and 973 may include a coupling recess 971, which is formed in one of the press body 931 and the support body 911, and a coupling protrusion 973, which is formed at the other one of the press body 931 and the support body 911 so as to be engaged with the coupling recess 971.

Once laundry is supported by the surface of the support body 911 and the press body 931 is coupled to the support body 911 using the coupling members 971 and 973, the laundry is pressed between the support body 911 and the press body 931, and hot air or steam supplied to the accommodation space 31 is supplied to the laundry through the body through-hole 933. Accordingly, the laundry treatment apparatus 100 of the present invention has the effects of removing wrinkles from laundry and sharpening a crease formed in laundry.

The laundry treatment apparatus 100 according to the embodiment may include a presser-fixing structure 200 for affixing the presser 9 to the inner surface 31*a* of the accommodation space 31 or the door 11.

The presser 9 according to the embodiment may be removably mounted to the inner surface 11*a* of the door 11.

Alternatively, the presser 9 may be removably mounted to the inner surface 31*a* of the accommodation space 31.

Figure 4:
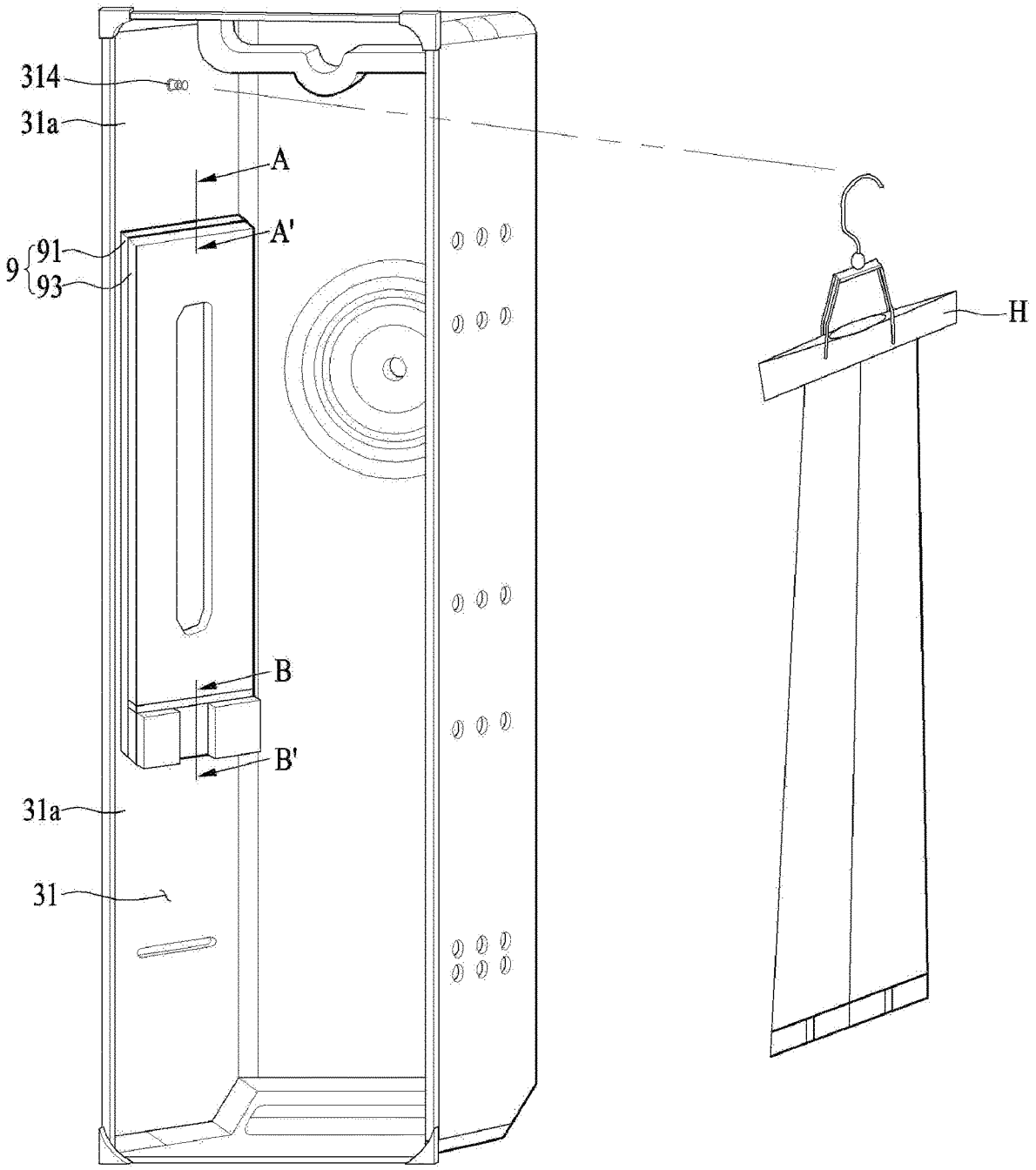
FIG. 4 is a view illustrating a laundry treatment apparatus according to another embodiment of the present invention.
Figure 5:
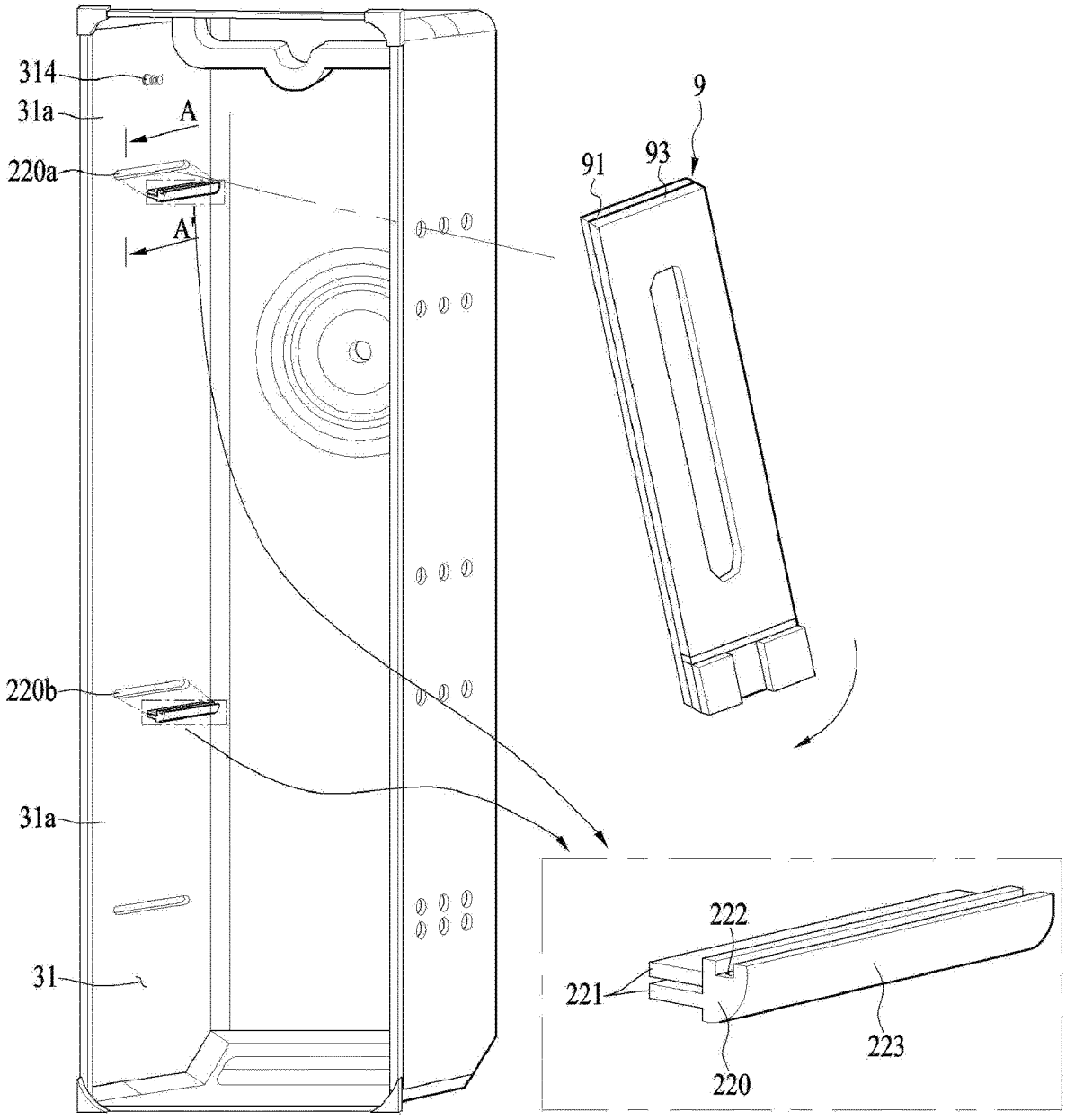
FIG. 5 is a view illustrating an exemplary configuration in which a presser is mounted to an inner surface of an accommodation space.
Figure 6:
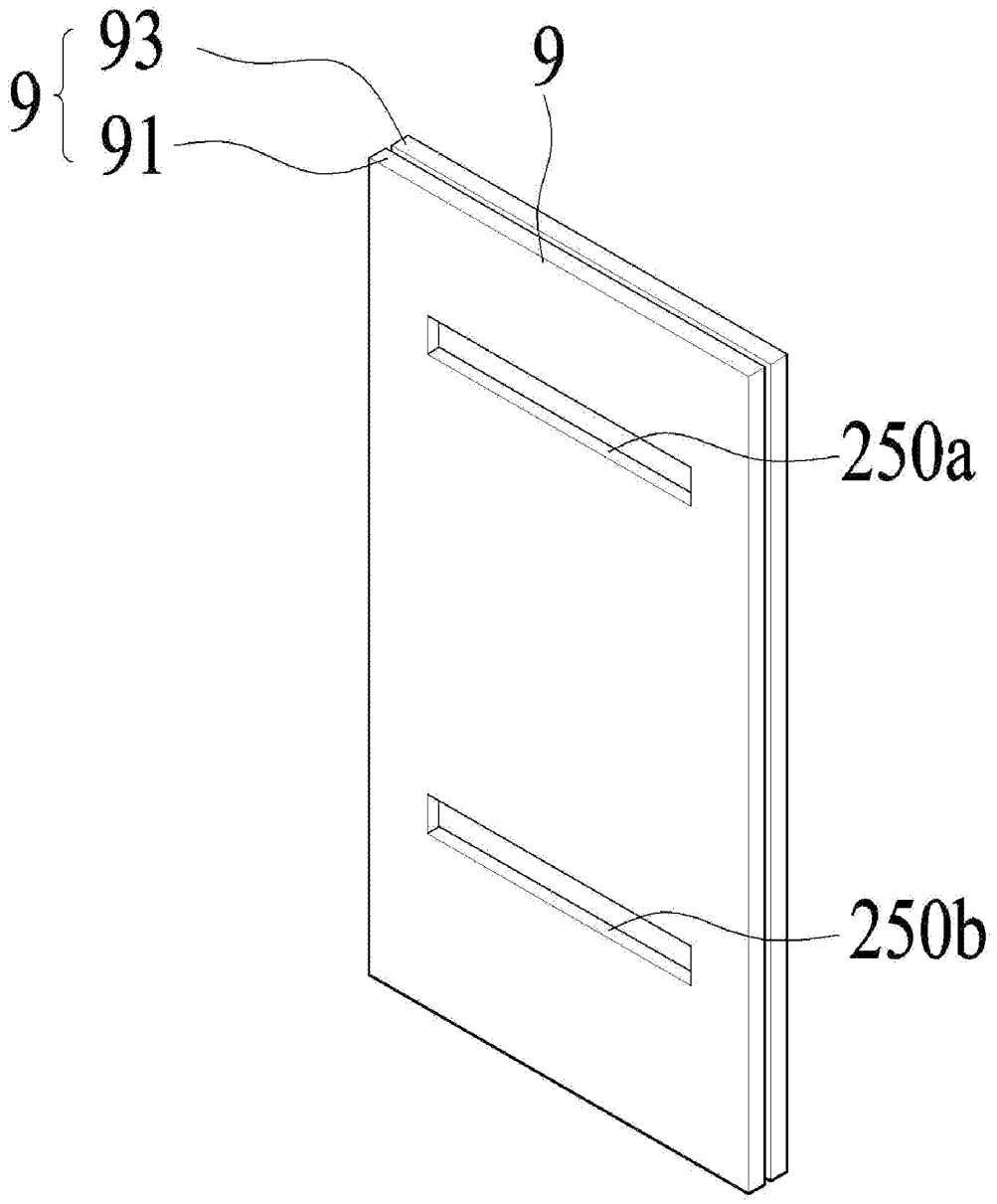
FIG. 6 is a view illustrating the rear surface of the presser.

FIG. 1 illustrates an exemplary configuration in which the presser 9 is mounted to the inner surface 11*a* of the door. FIG. 4 illustrates an exemplary configuration in which the presser 9 is mounted to the inner surface 31*a* of the accommodation space 31. FIG. 5 illustrates an example of mounting the presser 9 to the inner surface 31*a* of the accommodation space 31. FIG. 6 is a view illustrating the rear surface of the presser.

Hereinafter, the presser-fixing structure 200 for removably mounting the presser 9 to the inner surface 31*a* of the accommodation space 31 will be described with reference to FIG. 5. Of course, the presser-fixing structure 200 set forth below is also applicable to the configuration in which the presser 9 is mounted to the inner surface 11*a* of the door.

Figure 7:
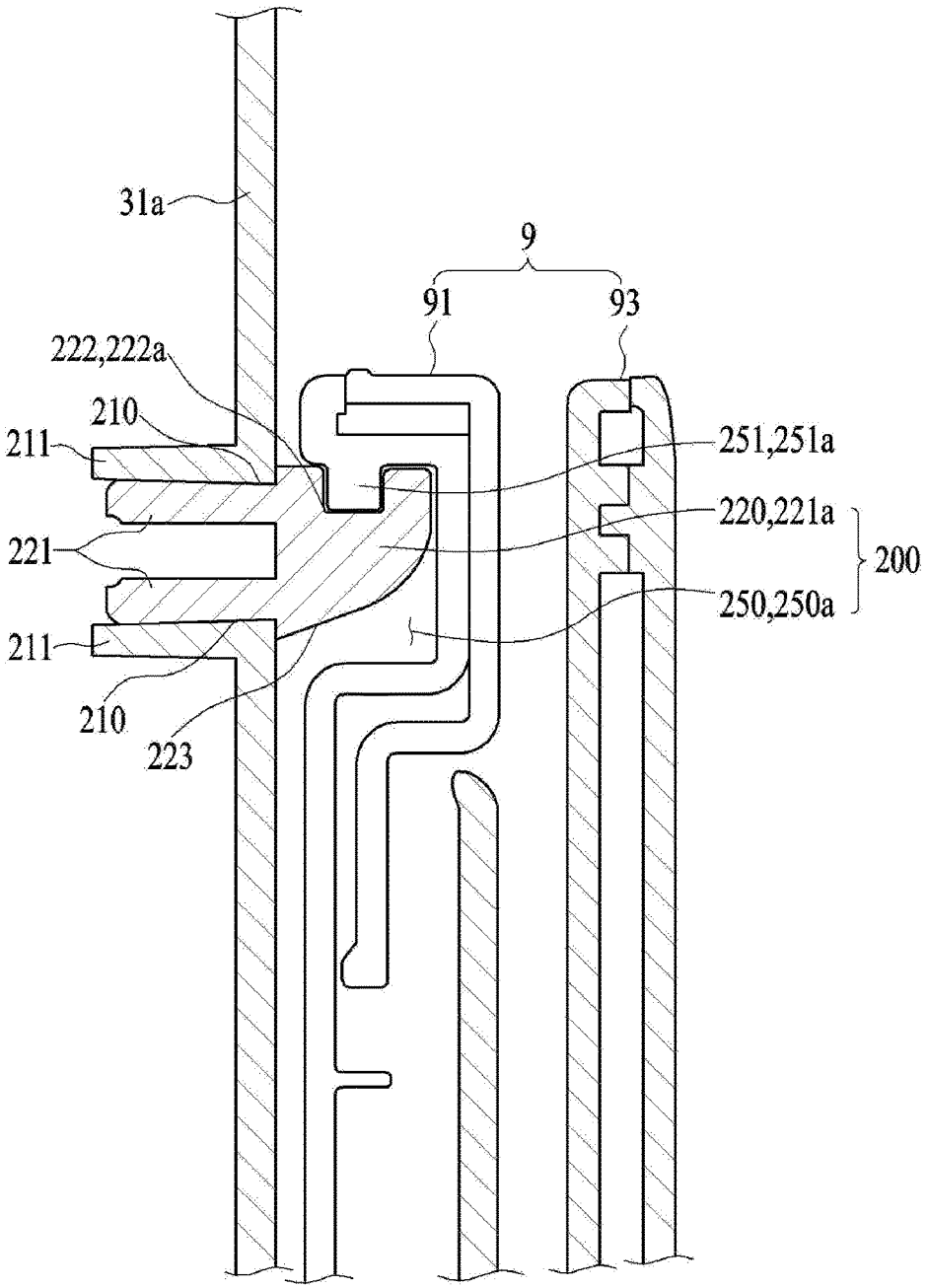
FIG. 7 is a sectional view taken along line A-A' in FIG. 4.
Figure 8:
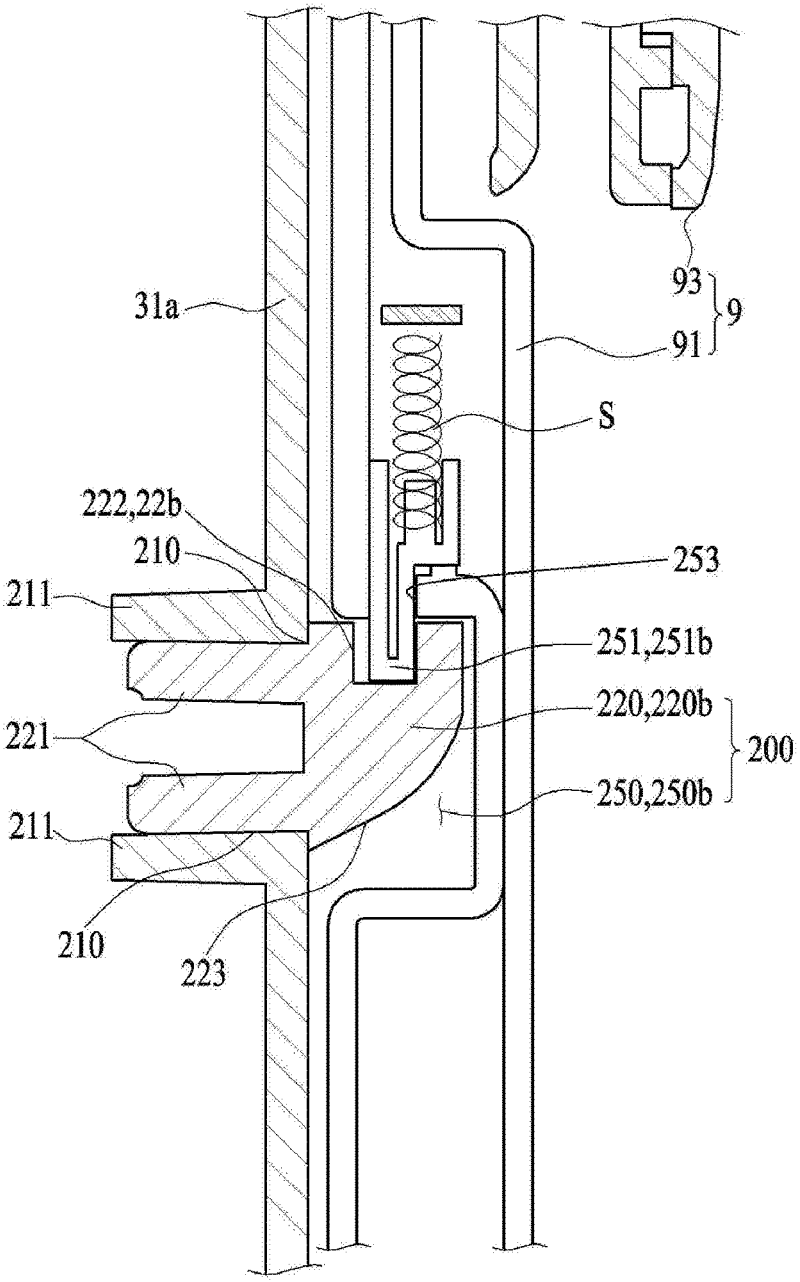
FIG. 8 is a sectional view taken along line B-B' in FIG. 4.

FIG. 7 is a sectional view taken along line A-A' in FIG. 4, and FIG. 8 is a sectional view taken along line B-B' in FIG. 4. The presser-fixing structure will now be described with reference to FIGS. 5 to 8.

The presser-fixing structure 200 may include a support holder 220, which protrudes from the inner surface 31*a* of the accommodation space 31 or the door 11, and a presser-fixing recess 250, which is concavely formed in the rear surface of the presser 9 so as to allow the support holder 220 to be inserted thereinto.

The presser 9 may be mounted in the accommodation space in a manner such that the support holder 220 is inserted into the presser-fixing recess 250 and the presser 9 is supported by the support holder 220.

The support holder 220 may be formed integrally with the inner surface 31*a* of the accommodation space 31 or the door 11. Alternatively, the support holder 220 may be configured as a separate member, which is removably coupled to the inner surface 31*a* of the accommodation space 31 or the door 11.

In the case in which the support holder 220 is configured as a separate member, as shown in FIG. 7, the laundry treatment apparatus according to the embodiment may include a support-part-fixing hole 210, which is formed in the inner surface 31*a* of the accommodation space 31 or the inner surface 11*a* of the door 11, and a support-part-fixing protrusion 221, which extends from the support holder 220 so as to be fitted into the support-part-fixing hole 210.

The support-part-fixing hole 210 may be formed in the inner surface 31*a* of the accommodation space 31 or the inner surface of the door 11, and may be provided with an extension portion 211 extending outwardly therefrom. The extension portion 211 serves to support the top and bottom of the support-part-fixing protrusion 221 so as to prevent the support-part-fixing protrusion 221 from being withdrawn out of the support-part-fixing hole 210 due to the load of the presser 9 and the laundry applied to the support holder 220.

The support holder 220 may have a support recess 222 formed concavely therein. The support recess 222 may be formed in the top surface or the bottom surface of the support holder 220.

There may be provided a presser-fixing protrusion 251, which protrudes from the inner surface of the presser-fixing recess 250 and is inserted into the support recess 222.

The presser-fixing protrusion 251 is inserted into the support recess 222 formed in the outer surface of the support holder 220, which is inserted into the presser-fixing recess 250, thereby preventing the support holder 220 from being separated from the presser-fixing recess 250.

In the case in which the support recess 222 is formed in the top surface of the support holder 220, the presser-fixing protrusion 251 may be formed so as to protrude downwards from the inner top surface of the presser-fixing recess 250.

As shown in FIG. 8, the presser-fixing protrusion 251 may be configured to be movable upwards and downwards by an elastic member S having elastic force.

The elastic member S is configured to apply elastic force to the presser-fixing protrusion 251 in the direction in which the presser-fixing protrusion 251 is inserted into the support recess 222.

The presser-fixing protrusion 251 may be configured to move linearly through a presser guide hole 253, which is formed in the presser-fixing recess 250.

The distal end of the presser-fixing protrusion 251 may be exposed into the presser-fixing recess 250 through the presser guide hole 253 by the elastic member S. When external force is applied to the presser-fixing protrusion 251, the presser-fixing protrusion 251 is inserted into the presser guide hole 253. The elastic member S serves to apply restoring force to the presser-fixing protrusion 251.

When the support holder 220 is inserted into the presser-fixing recess 250, the support holder 220 applies external force to the presser-fixing protrusion 251, whereby the presser-fixing protrusion 251 is inserted into the presser guide hole 253. When the support holder 220 is completely inserted into the presser-fixing recess 250, the presser-fixing protrusion 251 is inserted into the support recess 222 formed in the support holder 220, thereby preventing the support holder 220 from being separated from the presser-fixing recess 250.

In the case in which the presser 9 is mounted to the inner surface 31*a* of the accommodation space or the door, the coupling force is increased by the presser-fixing protrusion 251, which is maintained in the state of being inserted in the support recess 222, despite the load applied thereto by the presser and the laundry.

Meanwhile, the support holder 220 may have an inclined support portion 223 formed at the bottom thereof. The inclined support portion 223 may be formed so as to have a convexly curved surface.

The reason why the inclined support portion 223 is formed at the bottom of the support holder 220 is to separate the presser 9 from the inner surface 31*a* of the accommodation space or from the inner surface of the door.

In the state in which the support holder 220 is inserted into the presser-fixing recess 250, the inclined support portion 223 formed at the bottom of the support holder 220 may be spaced apart from the inner surface of the presser-fixing recess 250.

When a user moves the presser 9 upwards, the presser 9 is moved away from the inner surface 31*a* of the accommodation space or the inner surface of the door by the presser-fixing recess and the inclined support portion inserted therein.

In this case, the presser-fixing protrusion 251, which is inserted into the presser-fixing recess 250, may be separated from the support recess 222 formed in the support holder 220.

In the laundry treatment apparatus 100 according to the embodiment, the support holder 220 may include a first support holder 220*a* and a second support holder 220*b*, which is disposed below the first support holder 220*a* so as to be spaced a predetermined distance apart therefrom.

The presser-fixing recess 250 may include a first presser-fixing recess 250*a*, into which the first support holder 220*a* is inserted, and a second presser-fixing recess 250*b*, into which the second support holder 220*b* is inserted.

The first presser-fixing recess 250*a* and the second presser-fixing recess 250*b* are formed in the rear surface of the presser 9 and are spaced a predetermined distance apart from each other. The second presser-fixing recess 250*b* is disposed below the first presser-fixing recess 250*a*.

The first support holder 220*a* may have a first support recess 222*a* formed concavely therein, and the first presser-fixing recess 250*a* may be provided with a first presser-fixing protrusion 251*a*, which protrudes from the inner surface of the first presser-fixing recess 250*a* and is inserted into the first support recess 222*a*.

The second support holder 220*b* may have a second support recess 222*b* formed concavely therein, and the second presser-fixing recess 250*b* may be provided with a second presser-fixing protrusion 251*b*, which protrudes from the inner surface of the second presser-fixing recess 250*b* and is inserted into the second support recess 222*b*.

The first support recess 222*a* may be formed in the top of the first support holder 220*a*, and the second support recess 222*b* may be formed in the top or the bottom of the second support holder 220*b*.

In the case in which the second support recess 222*b* is formed in the top of the second support holder 220*b*, in order to couple the presser to the first support holder, which is located at a relatively high position, and the second support holder, which is located at a relatively low position, the first presser-fixing recess and the second presser-fixing recess are moved downwards from the positions above the first support holder and the second support holder so as to be engaged with the first support holder and the second support holder, respectively. In this case, the load of the presser may be stably dispersed to the top of the first support holder and the top of the second support holder.

Meanwhile, in the case in which the second support recess 222*b* is formed in the bottom of the second support holder 220*b*, the first support holder, which is located at a relatively high position, may first be engaged with the first presser-fixing recess, and subsequently the second support holder, which is located at a relatively low position, may be engaged with the second presser-fixing recess. In this case, the load of the presser is intensively applied to the top of the first support holder, and the second presser-fixing protrusion, which is inserted into the second support recess formed in the second support holder, prevents the presser from rotating about the first support holder.

At least one of the first presser-fixing protrusion 251*a* and the second presser-fixing protrusion 251*b* may be configured to be movable upwards and downwards by an elastic member having elastic force. In the embodiment of the present invention, it is desirable for the second presser-fixing protrusion 251*b* to be movable upwards and downwards by the elastic member and for the first presser-fixing protrusion 251*a* to be integrally fixed to the inner surface of the first presser-fixing recess.

Referring to FIGS. 5 and 6, the presser 9 may be mounted to the inner surface 31*a* of the accommodation space by inserting the first support holder 220*a* into the first presser-fixing recess 250*a*, inserting the first presser-fixing protrusion 251*a* into the first support recess 222*a*, and applying external force to the front surface of the presser 9.

Subsequently, while the second support holder 220*b* is inserted into the second presser-fixing recess 250*b*, it applies external force to the second presser-fixing protrusion 251*b*. When the second support holder 220*b* is completely inserted into the second presser-fixing recess 250*b*, the second presser-fixing protrusion 251*b* is inserted into the second support recess 222*b* formed in the top of the second support holder 220*b* by the restoring force of the elastic member applied thereto, thereby fixing the second support holder 220*b*.

As is apparent from the above description, the present invention provides a laundry treatment apparatus capable of performing washing, drying, deodorization, sterilization and wrinkle removal of laundry.

In addition, the laundry treatment apparatus according to the present invention removes wrinkles from laundry and applies pressure to laundry so as to sharpen a crease formed in the laundry.

In addition, the laundry treatment apparatus according to the present invention provides a presser that is removably mounted thereto so that the position of the presser may be moved.

In addition, the laundry treatment apparatus according to the present invention provides a presser that is greatly reduced in thickness so that the position of the presser may be efficiently moved in the inner space in the laundry treatment apparatus.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A laundry treatment apparatus comprising:

a cabinet having an accommodation space formed therein to accommodate laundry;

a door hingedly connected to the cabinet to open or close the accommodation space;

a presser configured to apply pressure to laundry to remove wrinkles from laundry; and a presser-fixing structure configured to removably affix the presser to an inner surface of the accommodation space or to an inner surface of the door, wherein the presser-fixing structure includes:

a support holder having a support recess therein and protruding from the inner surface of the accommodation space or from the inner surface of the door; and a presser-fixing protrusion provided at the presser, configured to be inserted into the support recess.

2. The laundry treatment apparatus of claim 1, wherein the support holder is formed integrally with the inner surface of the accommodation space or the inner surface of the door.

3. The laundry treatment apparatus of claim 2, wherein the support recess is provided on the top surface of the support holder.

4. The laundry treatment apparatus of claim 1, wherein the support holder is removably coupled to the inner surface of the accommodation space or the inner surface of the door.

5. The laundry treatment apparatus of claim 4, the presser-fixing protrusion is formed to protrude downward.

6. The laundry treatment apparatus of claim 1, wherein the support holder includes:

a first support holder having a first support recess; and a second support holder having a second support recess and being spaced downward apart from the first support holder.

7. The laundry treatment apparatus of claim 6, wherein the presser-fixing protrusion includes:

a first presser-fixing protrusion configured to be inserted into the first support recess; and a second presser-fixing protrusion configured to be inserted into the second support recess.

8. The laundry treatment apparatus of claim 7, wherein the first presser-fixing protrusion is configured to be downwardly inserted into the first support recess, and the second presser-fixing protrusion is configured to be downwardly inserted into the second support recess.

9. The laundry treatment apparatus of claim 1, further comprising a laundry support member for supporting laundry provided at the inner surface of the accommodation space or from the inner surface of the door, and wherein the presser comprises:

a support body; and a press body having one side hingedly connected to one side of the support body and an opposite side detachably attached to the opposite side of the support body.

10. The laundry treatment apparatus of claim 9, wherein the presser-fixing protrusion is provided at the support body.

* * * * *